US006315041B1

(12) United States Patent
Carlisle et al.

(10) Patent No.: US 6,315,041 B1
(45) Date of Patent: Nov. 13, 2001

(54) MULTI-ZONE ISOLATION TOOL AND METHOD OF STIMULATING AND TESTING A SUBTERRANEAN WELL

(76) Inventors: Stephen L. Carlisle, 1922 Clear Creek Dr., Weatherford, TX (US) 76087; Douglas J. Lehr, 71 Rockridge Dr., Woodlands, TX (US) 77381

( * ) Notice: Subject to any disclaimer, the term of this patent is extended or adjusted under 35 U.S.C. 154(b) by 0 days.

(21) Appl. No.: 09/292,547

(22) Filed: Apr. 15, 1999

(51) Int. Cl.[7] ..... E21B 23/06; E21B 33/1295; E21B 47/00; E21B 47/026; E21B 47/04; E21B 49/00

(52) U.S. Cl. ..... 166/250.17; 166/122; 166/134; 166/212

(58) Field of Search ..... 166/118, 120, 166/122, 134, 136, 212, 214, 250.17

(56) References Cited

U.S. PATENT DOCUMENTS 4,224,987 * 9/1980 Allen ..... 166/120
4,288,082 * 9/1981 Setterberg, Jr. ..... 277/125
4,311,195 * 1/1982 Mullins, II ..... 166/120

OTHER PUBLICATIONS

"Retrievable Bridge Plug," Map Oil Tools, Inc. (Retrievable Packers, pp. 9–9b, 1984—2).

Norris, Mark, Chris Teesdale, Peder Hobbesland, "Sand Plugs for Horizontal Well Fracturing Save Time and Money . . . If at First You Don't Succeed, Then Try, Try, Try Again!" *The Brief* (Nov. 1997).

Lehr, Doug, "Frac Shield and FIST Systems," Mobil Presentation, Dallas, Texas (Oct. 22, 1996).

"Typical Thru Tubing Applications," BJ Coiled Tubing Products and Services Catalogue. (Date Unknown).

* cited by examiner

*Primary Examiner*—David Bagnell
*Assistant Examiner*—Jennifer M Hawkins

(57) ABSTRACT

A tool for isolating segments of a wellbore. The tool includes a packing cup housed in a protective sheath during the insertion of the device into the wellbore. The packing cup is radially outward biased. The protective sheath is removable. Upon removal of protective sheath the packing cup expands and creates a seal with the wellbore. Pressurized fluid pumped through the tool increases pressure within the segment and tightens the packing cup seal. Packing cup also acts like a piston, imparting a force to a packing element predisposed to buckle in a radially outward direction. Packing element makes a second seal with the wall of the wellbore. A hydraulically actuated button slip assembly anchors the tool in place. The tool can contain significant pressure to facilitate well stimulation and completion by fracture or acidization. The tool can also be used to facilitate measuring production from an isolated segment of the well. The tool is resettable and can be maneuvered to isolate any desired length of the wellbore.

31 Claims, 14 Drawing Sheets

| | | | |
|---|---|---|---|
| FIG. 1A-1 | FIG. 1A-2 | FIG. 1A-3 | FIG. 1A-4 |
| FIG. 1B-1 | FIG. 1B-2 | FIG. 1B-3 | FIG. 1B-4 |
| FIG. 1C-1 | FIG. 1C-2 | FIG. 1C-3 | FIG. 1C-4 |

FIG. 1

| | | | |
|---|---|---|---|
| FIG. 4A-1 | FIG. 4A-2 | FIG. 4A-3 | FIG. 4A-4 |
| FIG. 4B-1 | FIG. 4B-2 | FIG. 4B-3 | FIG. 4B-4 |
| FIG. 4C-1 | FIG. 4C-2 | FIG. 4C-3 | FIG. 4C-4 |

FIG. 4

MULTI-ZONE ISOLATION TOOL AND METHOD OF STIMULATING AND TESTING A SUBTERRANEAN WELL

BACKGROUND OF THE INVENTION

1. Field of the Invention

This invention relates generally to the field of oil and gas well stimulation, and more particularly, to isolating segments of a subterranean cased or open hole well for stimulating and/or testing purposes. The invention is particularly well-suited for stimulating horizontal wellbores that extend through a naturally fractured reservoir.

2. Description of the Related Art

The field of oil and gas well stimulation sometimes involves wells with multiple horizontal laterals in a vertical well that are drilled to facilitate production from a formation. Some of the well laterals are substantially long, up to several thousand feet, and it is desirable to stimulate these horizontal well sections to increase their production. There are a number of stimulation methods, such as acidizing and fracturing. The typical way to stimulate the horizontal sections of a wellbore is to fill the entire horizontal wellbore with the desired stimulation fluid, increase the fluid pressure, and hope that the fluid encounters and enhances the formation's natural fractures. However, according to recent studies this method of stimulating a long horizontal section of a well only effectively treats the initial interval (e.g. the first one-thousand feet or so) of that section. It is desirable to enhance the natural fractures in the formation all the way to the end of the horizontal well, but current methods do not effectively provide for this. In order to effectively fracture a long horizontal well, the well needs to be isolated into sections which can each be independently stimulated.

One way to isolate horizontal sections of a well in anticipation of fracturing is to use inflatable packers. Inflatable packers can be maneuvered into a desired section of the horizontal well and set to isolate the section. However, inflatable packers have a limited pressure containing capacity, often not enough to facilitate fracture of a formation, and therefore they have a high tendency to fail and add significant downtime to the completion operation.

There is another tool, the Wizard Packer from Dresser, that allows isolation of a horizontal well into preset lengths to facilitate stimulation of the formation, but it requires sending darts into the sections to open sliding sleeves which allow the treating fluid to enter into the isolated section. Despite the isolation, there is sometimes still no stimulation within the preset segment if one or more of the interval sections does not contain a natural fracture to enhance. There is no way to adjust the isolated length and effectively stimulate a new length without removing and resetting the entire system. The Wizard Packer is often prohibitively expensive, and is not retrievable. The Wizard Packer is fairly long in length and rigid, such that it often cannot negotiate small radius turns in a wellbore. There is a need for a less expensive, more maneuverable tool to isolate sections of the horizontal lateral at any length without removing the tool from the wellbore since the time and expense for each entry and withdrawal of a tool from a well is significant. The location of the natural fractures within a wellbore may not be known, and presetting the isolated lengths allows no flexibility for moving and adjusting the sections to find natural fractures to enhance.

In addition, there is no effective method of testing the sections of a horizontal wellbore for their respective production levels following stimulation.

The present invention is directed to overcoming, or at least reducing the effects of, one or more of the problems set forth above.

SUMMARY OF INVENTION

In one aspect of the present invention, a FracShield assembly for isolating and stimulating single or multiple sections of a substantially horizontal or vertical wellbore in a single trip is provided. The assembly according to one embodiment comprises a mandrel with a topsub, a plurality of anchoring hydraulic buttons, a packing element, and a sealing cup. The sealing cup is housed within a removable protective sheath. The assembly is self-sealing upon the application of pressure within the isolated well segment and is designed primarily to facilitate fracturing a horizontal well when a pressurized fluid is introduced into the isolated section. The assembly is deployed by pumping a ball or dart through the work string and the mandrel of the assembly, which seats in the protective sheath until the pressure within the mandrel reaches a level necessary to shear the holding pins and jettison the sheath from the tool. Upon removal of the sheath, the sealing cup, which is radially outward biased, creates a seal with the inner circumference of the wellbore. The device may include a second seal that is also pressure activated to further contain significant pressure during the stimulation of the well. After stimulating a particular section of the wellbore, the assembly is pulled uphole and reset to stimulate another section of the wellbore. Thus, the assembly permits stimulating multiple zones of the wellbore in a single trip.

According to another embodiment, the assembly exhibits a plurality of slip-on-cone-type anchoring slips. The slips begin to traverse the cone when the pressure on the sealing cup reaches a predetermined level, and the slips continue to move longitudinally and radially along the cone until they anchor themselves in the wall of the wellbore. The slip assembly for gripping the wall of the wellbore in this embodiment can move relative to the mandrel in cases of contraction of the work string to which the mandrel is connected, or in other circumstances. The movement of the slip assembly is controlled by a control collet which includes several collet fingers initially engaged with a shoulder.

The device can be used for production testing of isolated well segments as well. When a well is completed, the tool can be used to isolate segments of the well to facilitate testing each interval for its respective production level.

One embodiment of the device is a single trip multiple-zone isolation tool for stimulating or testing a wellbore that includes a mandrel with a bore therethrough, multiple hydraulically actuated buttons that are arranged radially about the outer diameter of the mandrel for gripping the wall of the wellbore, and a sealing cup coaxially arranged about the mandrel wherein the the sealing cup is radially biased to extend to the diameter of the wall of the wellbore. The mandrel is adapted for connection to a jointed pipe or coiled tubing, the sealing cup is covered by a protective sheath during tool run-in, and the hydraulically actuated buttons are operable in response to hydraulic pressure to move radially outward to engage the wall of the wellbore. As the hydraulic pressure increases, the sealing force of the sealing cup against the wall of the wellbore also increases causing the portion of the wellbore adjacent to the tool to become isolated. The protective sheath is attached to the mandrel by multiple releasable means to ensure the sheath remains in place until it is desirable to jettison it from the end of the tool. These releasable means may include shear screws, collet fingers, or an interlock system. The interlock system may be unlocked by internal hydraulic pressure, allowing the sheath to be jettisoned from the tool.

In one embodiment the tool exhibits a secondary seal comprising a packing element that is predisposed to buckle under the application of longitudinal force and seal against the wall of the wellbore. This packing element returns to its pre-buckle condition upon the removal of longitudinal force. The hydraulically actuated buttons or slips return to their run-in positions when internal pressure is substantially equalized with annular pressure.

The present invention is directed to methods of stimulating a wellbore. The method for stimulating a subterranean well comprises: a) running an isolation tool on a jointed pipe or coiled tubing into the well and positioning the tool adjacent a first interval of interest; the isolation tool comprising a mandrel having a bore therethrough, a plurality of hydraulically actuated buttons or slip-on-cone-type anchoring slips arranged about the mandrel for gripping the wall of the wellbore, and a sealing cup coaxially arranged about the mandrel wherein the sealing cup is radially biased to extend to the wall of the wellbore with the sealing cup initially covered by a protective sheath; b) pressurizing the jointed pipe or coiled tubing to jettison the protective sheath circumscribing a sealing cup from the end of the tool and actuate the hydraulically actuated buttons or slip-on-cone-type anchoring slips into engagement with the wall of the wellbore; c) isolating the interval of interest with a seal formed by the sealing cup against the wellbore wall; d) stimulating the isolated interval by hydraulic fracturing or acidizing; e) placing a plug downhole of the tool; f) substantially equalizing the internal pressure of the work string and tool with the annular pressure to release the tool from the wall of the wellbore; g) moving the tool uphole a desirable distance, resetting the hydraulically actuated buttons or slips, and forming a seal with the sealing cup by pressurizing the jointed pipe or coiled tubing; h) stimulating the new interval; i) substantially equalizing the internal pressure of the tool with the annular pressure to release the tool from the wall of the wellbore; and j) repeating the steps (g)–(i) until all the intervals of interest are stimulated.

The method of stimulating a subterranean well may also comprise the steps of: a) running the isolation tool on a jointed pipe or coiled tubing into the well and positioning the tool adjacent a first interval of interest, wherein the isolation tool comprises a mandrel having a bore therethrough, a hydraulically actuated button or slip assembly arranged about the mandrel for gripping the wall of the wellbore, a sealing cup coaxially arranged about the mandrel wherein one end of the sealing cup is radially biased to extend to the wall of the wellbore, and wherein the sealing cup is initially covered by a protective sheath; b) releasing the protective sheath from the tool to expose the sealing cup; c) actuating the slip assembly to engage the wall of the wellbore; d) isolating the interval by forming a seal against the wellbore wall with the sealing cup; e) stimulating the interval; f) placing a plug downhole of the tool; g) releasing the tool from the wall of the wellbore; h) moving the tool uphole and positioning the tool adjacent a new interval and repeating steps (c)–(h) until all intervals of interest have been stimulated. This method may alternatively include only steps (a)–(e) without any repetition.

The present invention is also directed toward methods for testing a subterranean well. The method for testing a subterranean well may comprise: a) running the isolation tool on a jointed or coiled tubing into the well and positioning the tool adjacent the first interval of interest, the isolation tool comprising a mandrel having a bore therethrough, a plurality of hydraulically actuated buttons arranged about the mandrel for gripping the wall of the wellbore and a sealing cup coaxially arranged about the mandrel wherein the sealing cup is radially biased to extend to the wall of the wellbore with the sealing cup initially covered by a protective sheath; b) pressurizing the jointed pipe or coiled tubing to actuate the anchoring hydraulically actuated buttons to engage the wall of the wellbore and to jettison the protective sheath circumscribing a sealing cup from the end of the tool; c) isolating the interval of interest with a seal formed by the sealing cup against the wellbore wall; d) reducing work string pressure and allowing production fluids from the formation to flow through the interior passageway of the tool and to the jointed pipe or coiled tubing string; e) measuring production from the isolated interval, f) substantially equalizing the internal pressure of the jointed pipe or coiled tubing with the annular pressure to release the tool from the wall of the wellbore; g) moving the tool uphole a desirable distance and reducing annular pressure to allow the hydraulically actuated buttons to actuate and the sealing cup to again seal; h) measuring production from the new interval or combined intervals; i) substantially equalizing the internal pressure on jointed pipe or coiled tubing with the annulus pressure to release the tool from the wall of the wellbore; and j) repeating steps (g)–(i) until the entire interval of interest is tested.

The method for testing a subterranean well may also comprise: a) running the isolation tool on a jointed or coiled tubing into the well and positioning the tool adjacent the first interval of interest, the isolation tool comprising a mandrel having a bore therethrough, a plurality of slip-on-cone-type anchoring slips arranged about the mandrel for gripping the wall of the wellbore and a sealing cup coaxially arranged about the mandrel wherein the sealing cup is radially biased to extend to the wall of the wellbore with the sealing cup initially covered by a protective sheath; b) pressurizing the jointed pipe or coiled tubing to jettison the protective sheath circumscribing the sealing cup from the end of the tool; c) actuating the slip-on-cone-type anchoring slips; d) isolating the interval of interest with a seal formed by the sealing cup against the wellbore wall; e) reducing jointed pipe or coiled tubing pressure and allowing production fluids from the formation to flow through the interior passageway of the tool and to the production tubing; f) measuring production from the isolated interval, g) substantially equalizing the internal pressure of the work string with the annular pressure to release the tool from the wall of the wellbore; h) moving the tool uphole a desirable distance and reducing annular pressure to allow the sealing cup to seal and the slips to actuate again; i) measuring production from the new interval or combined intervals; j) substantially equalizing the internal pressure on the jointed pipe or coiled tubing with the annular pressure to release the tool from the wall of the wellbore; and k) repeating steps (h)–(j) until the entire interval of interest is tested.

The testing method may also comprise the steps of: a) running an isolation tool on a jointed pipe or coiled tubing into said well and positioning the tool adjacent a first interval of interest, wherein the isolation tool comprises a mandrel having a bore therethrough, a slip assembly arranged about the mandrel for gripping the wall of the wellbore and a sealing cup coaxially arranged about the mandrel wherein one end of the sealing cup is radially biased to extend to the wall of the wellbore and wherein the sealing cup is initially covered by a protective sheath; b) releasing the protective sheath from the tool to expose the sealing cup; c) actuating the slip assembly to engage the wall of the wellbore; d) isolating the interval by forming a seal against the wellbore wall with the sealing cup; e) testing the interval; f) releasing the tool from the wall of the wellbore; g) moving the tool uphole and positioning the tool adjacent a new interval and repeating steps (c)–(g) until all intervals of interest have been tested.

The methods for stimulating a subterranean may include hydraulic fracturing and acidizing of the formation. The stimulating and testing method may include placing a plug at each interval, this plug may be a sand plug, and chemical plug, a mechanical plug, or other plug known in the art. The stimulating and testing method may also include pressurizing the annulus of the wellbore to help facilitate the release of the tool from the walls of the wellbore.

BRIEF DESCRIPTION OF THE DRAWINGS

The foregoing and other features and aspects of the invention will become apparent upon reading the following detailed description and upon reference to the drawings in which:

FIGS. 1B-1 to 1B-4 depicts the FracShield just after the protective sheath has been jettisoned from the tool.

FIGS. 1C-1 to 1C-4 depicts the FracShield fully deployed and under the application of pressure.

FIG. 2 depicts a top crossectional view of the hydraulically actuated button slips assembly.

FIG. 3 depicts a second crossectional view of the hydraulically actuated button slips assembly.

FIGS. 4A-1 to 4A-4 depicts an alternative embodiment of the FracShield in the run-in position.

FIGS. 4B-1 to 4B-4 depicts the alternative embodiment just after the protective sheath has been jettisoned from the tool.

FIGS. 4C-1 to 4C-4 depicts the alternative embodiment of the FracShield fully deployed and under the application of pressure.

Figures 1, 1A:
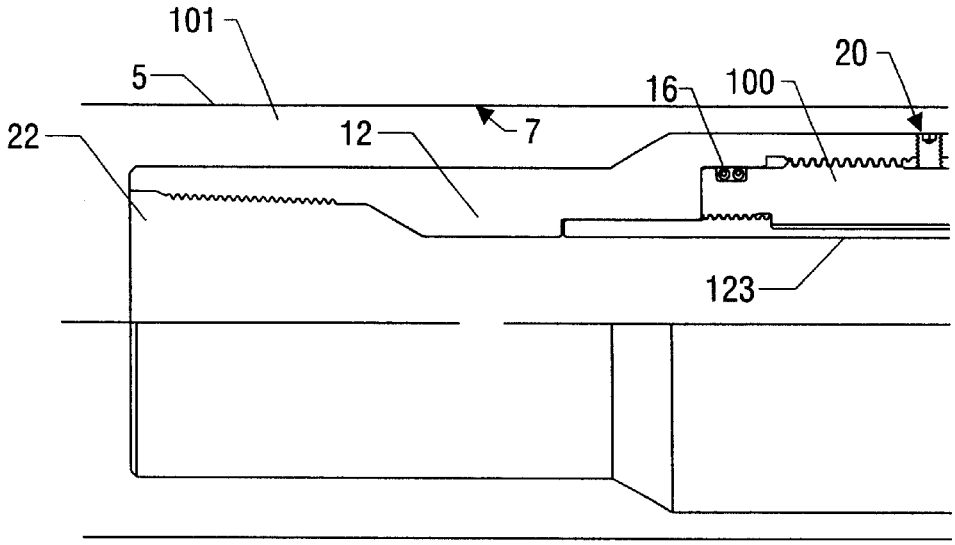
FIGS. 1A-1 to 1A-4 depicts a crossection of a FracShield device in accordance with one embodiment of the present invention.
Figures 1, 1B:
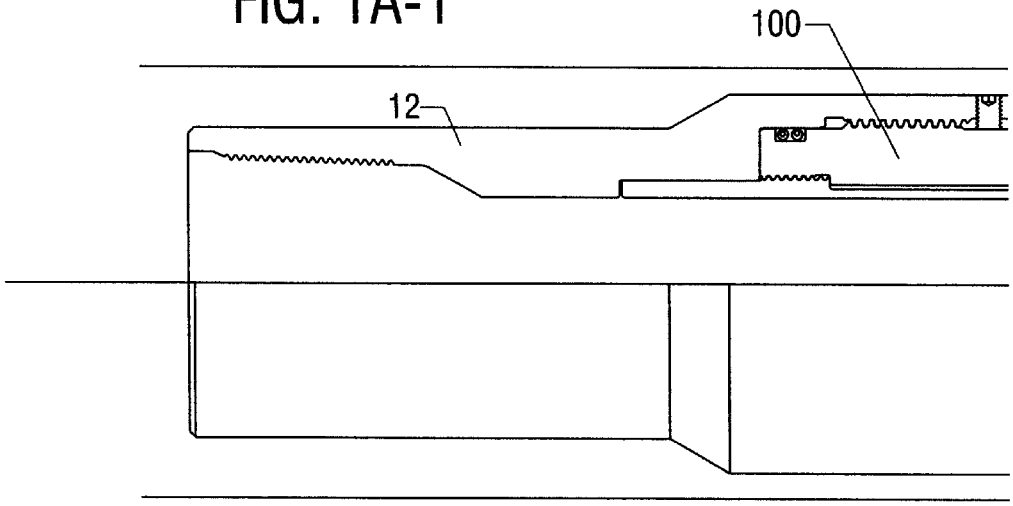

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Figures 1, 1C:
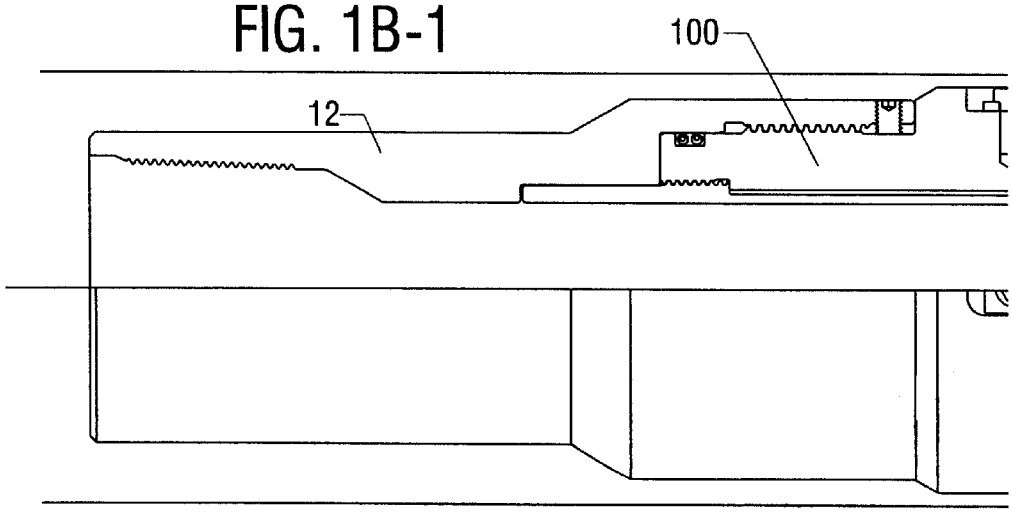
Figures 1, 1A, 2:
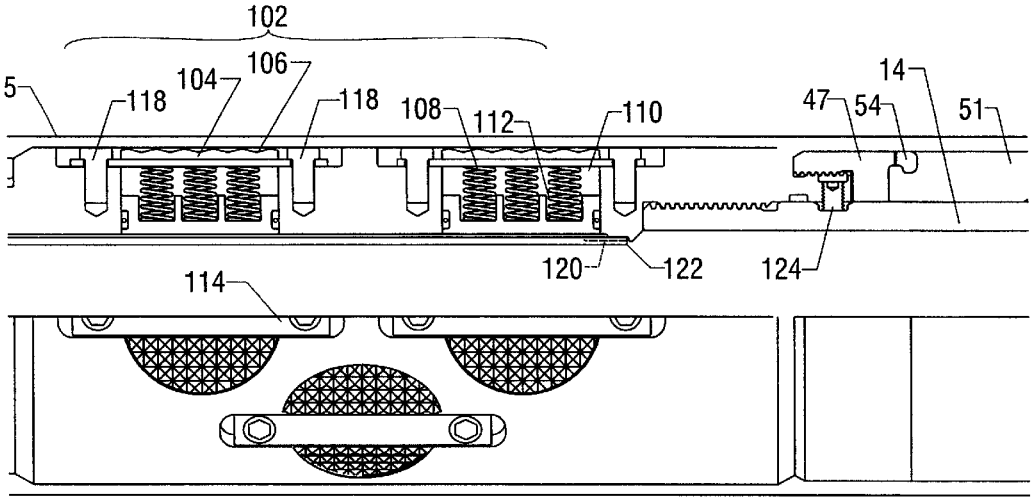
Figures 1, 1B, 2:
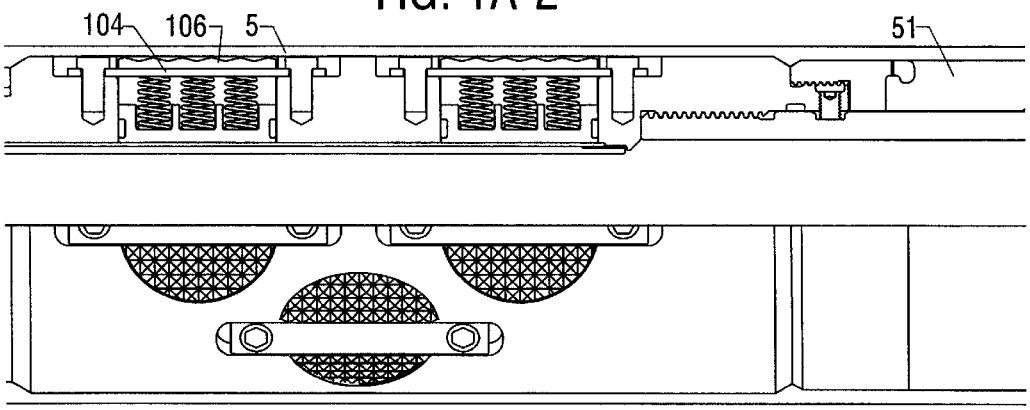
Figures 1, 1C, 2:
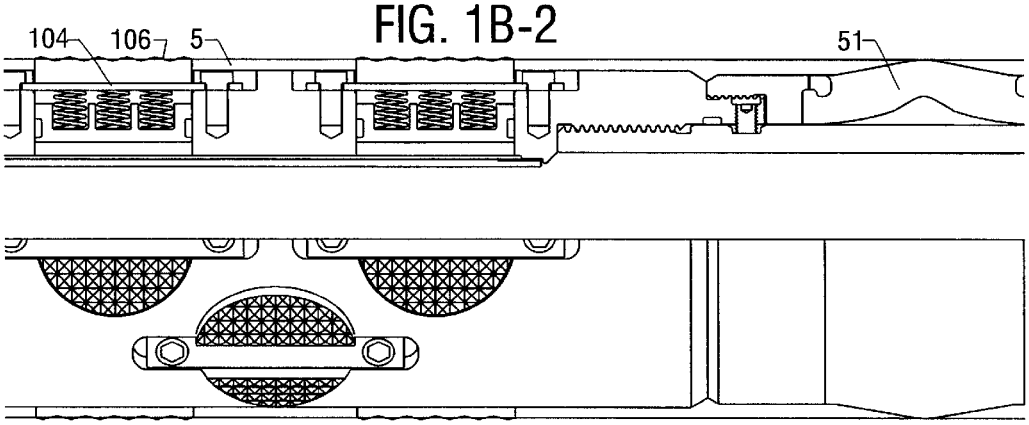
Figures 1, 1A, 2, 3:
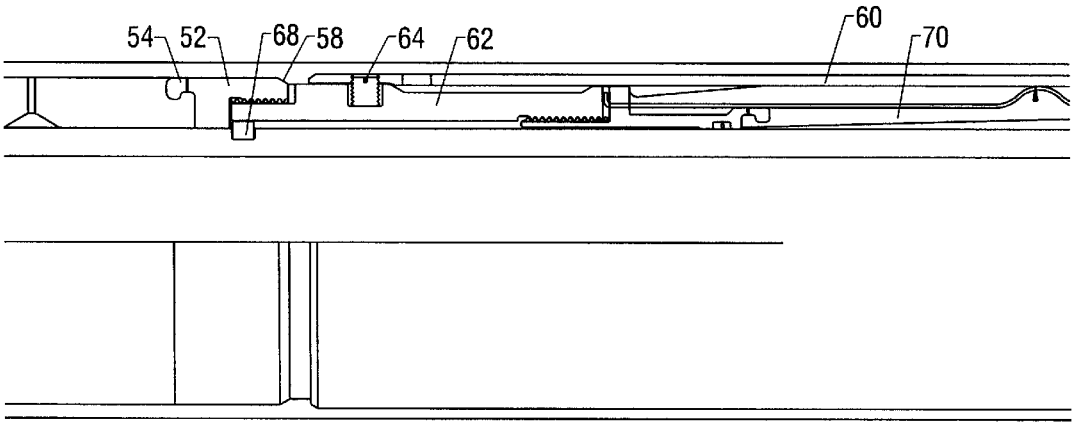
Figures 1, 1B, 2, 3:
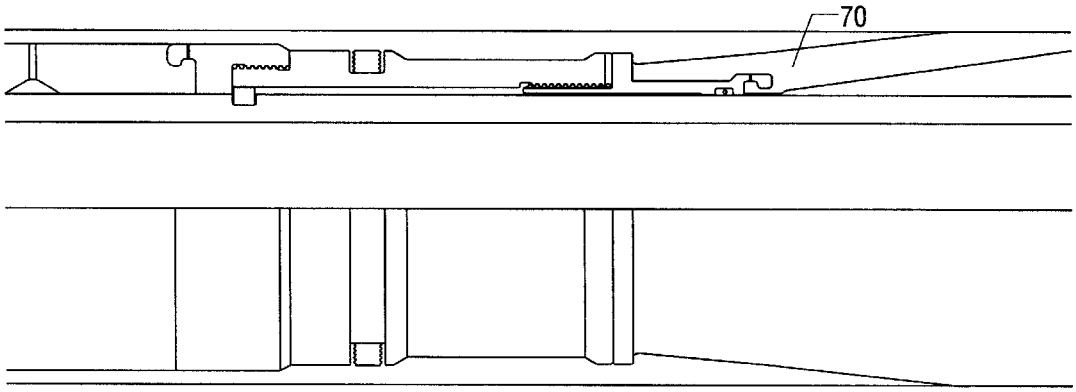
Figures 1, 1C, 2, 3:
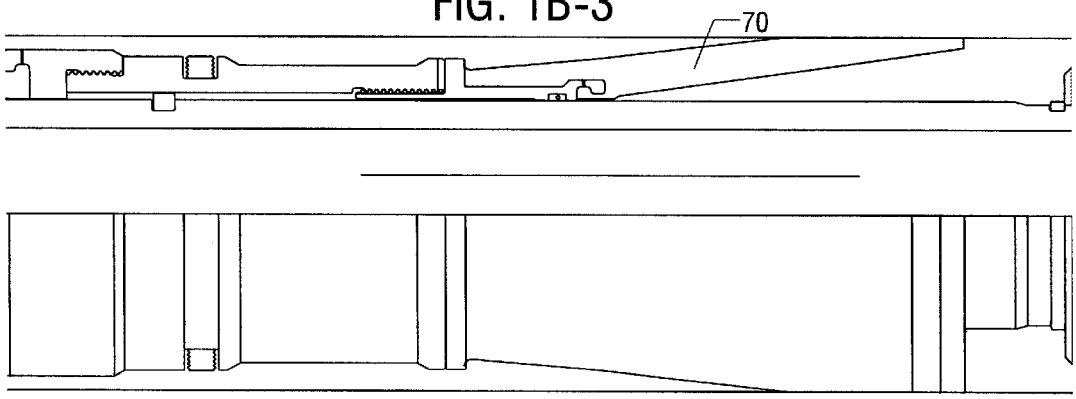

Turning now to the drawings, and in particular to FIGS. 1A-1 to 1C-4, a preferred embodiment of the FracShield assembly is illustrated in a wellbore 5 in accordance with the present invention. Beginning at the top of the tool, an internally threaded topsub 12 is attached to an externally threaded receptacle 100. The topsub is designed such that a jointed work string of drill pipe or tubing can be attached to the top of the device. Alternatively, the topsub may be adapted to be connected to a coiled tubing work string. Disposed within topsub 12 are a plurality of O-rings 16 which act as seals. The topsub position relative to receptacle 100 is secured by a plurality of set screws 20, for example four set screws spaced about the circumference of the topsub may be used. Receptacle 100 comprises the housing of the tool anchoring assembly. The anchoring assembly includes a plurality of hydraulically actuated buttons 104 that are disposed within receptacle 100. Hydraulically actuated buttons 104, shown in FIGS. 1A-2 to 1C-2, are radially arranged about the outer diameter of the tool. Each of the hydraulically actuated buttons include a geometric pattern of gripping teeth 106 comprising the outer surface of the hydraulically actuated buttons. The tooth geometry may be adjusted depending on the conditions of the rock formation and/or casing in which the tool is to be anchored. The outer surfaces of hydraulically actuated buttons 104 are flush with or recessed within the outer diameter of receptacle 100 in the tool run-in position as illustrated in FIG. 1A-2. Each hydraulically actuated button 104 has a button strap 114 extending across the diameter of the button, the strap being secured at both ends by a bolt 118. Button strap 114 constrains the force of a plurality of springs 108 which are located in holes 112 in hydraulically actuated button 104. The springs 108 are disposed between button strap 114 and the bottom of hydraulically actuated button 104. FIGS. 2 and 3 illustrate a crossectional view of the hydraulically actuated buttons assembly (springs not shown for clarity). The springs are radially inward biased with the tendency of each to retract the slips into receptacle 100. Buttons 104 are hydraulically actuated by fluid manipulation through the work string when it becomes necessary to anchor the tool in a desired position within a wellbore.

The inner surface of receptacle 100 comprises a button sleeve 123 that is threadedly attached to the receptacle opposite the connection to the topsub 12. The button sleeve exhibits a plurality of small slots 120 cut into its outer diameter to permit fluid pressure communication to hydraulically actuated buttons 104 while minimizing any admission of solid particles. The fluid path reaches slot 120 after negotiating a gap 122 at the distal end of button sleeve 123 which also limits solid particle entry. As the fluid pressure increases, the pressure is communicated to hydraulically actuated button 104 which overcome the restraining spring force and move in a radially outward direction until they contact a wall 7 of the wellbore and anchor the tool in place.

Receptacle 100 is threaded both internally and externally at its lower end. The internal threading of the receptacle attaches about the outer diameter of a mandrel 14. The position of the receptacle relative to the mandrel is secured by a plurality of set screws 124. Mandrel 14 exhibits a passageway 22 therethrough, said passageway providing for the introduction of fluid through the device and into the isolated section of the well for stimulation of the formation. Passageway 22 is also formed by the inner diameters of button sleeve 123 and top sub 12 at the upper end of the tool. The external threading of the receptacle attaches to an upper gage ring 47. The threaded upper gage ring 47 is bonded to the upper side of an elastomeric packing element 51. In an alternative embodiment, the packing element might be polymeric. A lower gage ring 52 is similarly bonded to the lower side of packing element 51. Both of the gage rings include a retainer 54 for holding packing element 51 in place. Packing element 51 is predisposed to buckle in a radially outward direction upon the application of longitudinal force. As more wellbore pressure downhole of the FracShield assembly is applied to the work string, packing element 51 seals against wellbore 5. FIGS. 1C-2 and 4C-2 show packing element 51 in the buckled position creating a seal against the wellbore. Packing element 51 is a backup seal to a sealing cup 70, which is discussed below. In an alternative embodiment, packing element 51 is not a part of the assembly.

Lower gage ring 52 is threadedly connected to a retainer 62. Retainer 62 houses a plurality of upper shear screws 64 and exhibits an internal counterbore. Disposed between the retainer and the mandrel is a pick up ring 68 which prevents relative downward movement of retainer 62 with respect to mandrel 14. Retainer 62 makes a threaded connection to a sealing cup 70 that is immediately below the retainer. Sealing cup 70 is radially outward biased such that when protective sheath 60 is jettisoned from the bottom of the device, sealing cup 70 moves radially outward and forms a seal with the wall of wellbore 5. In the preferred embodiment sealing cup 70 might comprise a highly abrasion-resistant nitrile rubber, possibly with the addition of internal reinforcement, or some other polymeric material conducive to the wear resulting from moving the device in open hole without the protective sleeve.

In a preferred embodiment, protective sheath 60 is primarily held in a position circumscribing sealing cup 70 by an assembly of collet fingers 72 and an interlock sleeve 77. An end 61 of protective sheath 60 may abut a notch 58 in lower gage ring 52 in the run-in position as shown in FIGS. 1A-3 and 4A-3. A plurality of shear screws 74 secure the interlock sleeve in position relative to the mandrel. Collet fingers 72 and interlock sleeve 77 ensure that the sheath cannot be separated from the tool except by hydraulic actuation. This feature is desirable when, for example, the tool becomes stuck during insertion, particularly in an open hole wellbore. Sheath 60 protects sealing cup 70 from damage as the assembly is run into the wellbore. When the tool is going through a tight section of the wellbore there may be significant frictional forces on sheath 60 that would tend to force it from the end of the device. If sheath 60 were to come off, the tool could not be advanced down the wellbore without risking damage to sealing cup 70 because of its natural outward bias. The collet fingers and interlocking sleeves, combined with multiple shear screws, ensure a robust design such that a mechanical force alone cannot release the sheath, the force must be accompanied by hydraulic actuation that releases the interlock. The second set of shear screws 64 are included in the present embodiment to further secure sheath 60 over sealing cup 70. Upper shear screws 64 prevent gage rings 47 & 52 and packing element 51 from moving up relative to the mandrel. The gage rings or packing element may have a tendency to move relative to the mandrel if, for example, one of them comes into contact with the wall of the wellbore during insertion of the assembly. The restricted movement of these elements prevents the premature activation of packing element 51.

Figure 8:
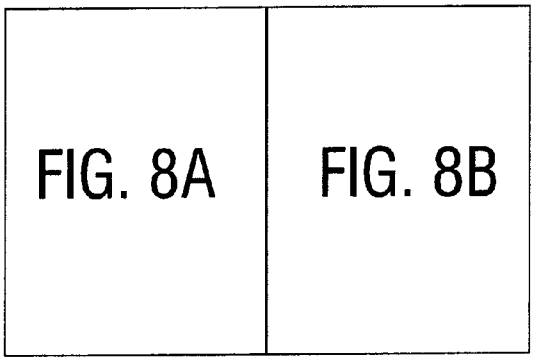
FIG. 8 depicts one embodiment of the invention in a wellbore after the sheath has been jettisoned from the tool.
Figure 8A:
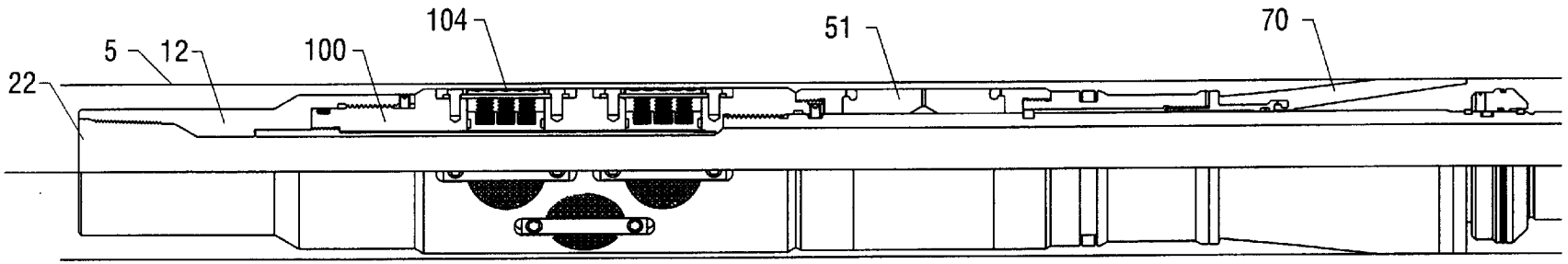
Figure 8B:
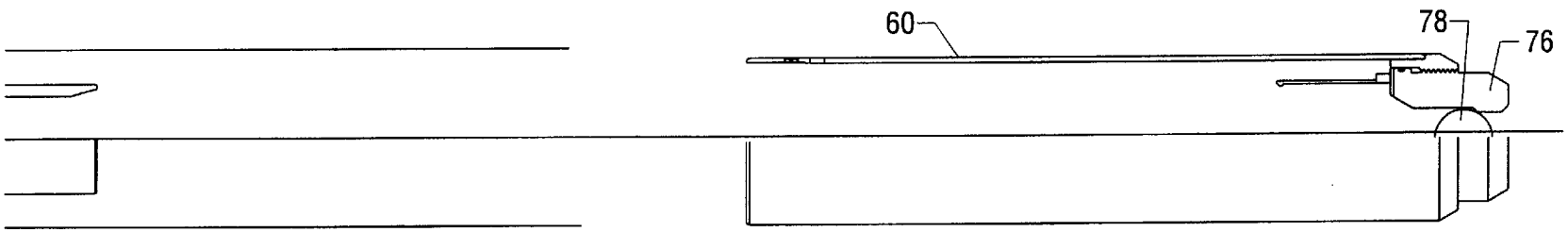

The lower end of the protective sheath houses a ball seat assembly 76. The ball seat assembly is designed to receive a ball 78 when it becomes desirable to jettison sheath 60 from over sealing cup 70. A ball is dropped from the surface and circulated down the jointed pipe or coiled tubing. The ball continues to be circulated through the interior of the tool until it rests on and makes a seal with ball seat assembly 76. As internal pressure is increased, a conduit 75 facilitates fluid communication with interlock sleeve 77 such that an upward force is transmitted to the interlock sleeve. When the internal pressure reaches a predetermined value, interlock sleeve 77, which is a toroidal piston, shears shear screws 74 and uncovers collet fingers 72. After collet fingers 72 have been uncovered, upper shear screws 64 shear, allowing ball seat 76 and protective sheath 60 to be jettisoned longitudinally downward relative to the mandrel as shown in FIG. 8. The sheath is left in the wellbore, as it is not necessary to retrieve it following the fracturing operation. It will also be understood that other types of sealing devices, such as a dart, may be used as a suitable alternative to ball 78.

Operation of the FracShield may be illustrated as follows. The FracShield is run into a cased or open hole wellbore on a work string and positioned adjacent to the interval of interest. The work string may include jointed pipe, tubing, or coiled tubing. While the shield is being inserted, hydraulically actuated buttons 104 of anchoring assembly 102 are flush with or recessed within the outer diameter of receptacle 100 to allow the tool to be inserted without hindrance from teeth 106 of the hydraulically actuated buttons creating friction against the wall of the wellbore. If the FracShield encounters resistance to movement within the wellbore due to a tight spot or some other hindrance, the tool facilitates fluid circulation either down the tubing, through the tool, and up the annulus; or down the annulus, through the tool, and up the tubing to help release the tool from the tight spot.

Once the tool has been positioned adjacent to the first interval of interest, a ball is deployed and circulated down through the work string. The ball continues to circulate through the interior of the tool and eventually lands on ball seat assembly 76 of protective sheath 60. The ball makes a seal with seat 76 and the pressure inside the work string is increased. When the pressure inside the tool reaches a predetermined level, interlock sleeve 77 shears shear screws 74 and uncovers collet fingers 72. The uncovered collet fingers release, and the internal pressure forces sheath 60 to jettison from the end of the tool. The amount of pressure required to jettison the sheath will be a function of the number of shear screws used and the shear strength of the screws. By way of example, the sheath may be jettisoned when the internal pressure exceeds 1000 psi. FIGS. 1B-1 to 1B-4 illustrate the tool immediately after the protective sheath has been jettisoned from the tool. The sheath may remain in the well, as it is intended to be expendable. Sheath 60 may be made, for example, of a degradable material.

With sheath 60 no longer on the tool, sealing cup 70, which is radially outward biased, immediately expands and makes contact with the walls of the wellbore. Pressurized treating fluid from the work string continues through the interior of the tool and comes into contact with the isolated section of the well. The pressure in the isolated section of the wellbore forces sealing cup 70 to form an even tighter seal with the walls of the well. The higher the pressure, the tighter the seal of the sealing cup with the wellbore. In addition to creating a seal, the pressure on packing cup 70 allows the cup to act like a piston, which pushes back against retainer 62. Retainer 62 communicates this force to lower gage ring 52, which may be bonded to packing element 51. Packing element 51 is then compressed until the force acting on it from lower gage ring 52 reaches a level that causes packing element 51 to buckle. The buckling occurs in a predisposed way such that the packing element moves in a radially outward manner. The packing element continues to buckle until it seals against the wall of the wellbore. FIG. 1C-2 exhibits packing element 51 in the buckled position forming a seal with the wall of the wellbore. The packing element seal is a secondary seal, further ensuring that the pressurized fluid from the work string is not transmitted to other sections of the well. Before the pressure builds to a level high enough to buckle the packing element, however, the pressure inside the tool reaches a predetermined level that actuates hydraulically actuated buttons 104 to extend radially outward until teeth 106 of the slips engage the walls of the wellbore, securing the tool in .position as shown in FIGS. 1C-1 to 1C-4.

With the tool anchored and a double seal accomplished, the isolated wellbore section can be effectively treated. For example, the natural fractures in the formation may be hydraulically fractured and/or acidized to increase their productivity.

When the stimulation treatment for the isolated section is complete, a plug, for example a sand, chemical, or mechanical plug, may be placed in the wellbore adjacent the formation to keep this section of the wellbore isolated from subsequent treatments. Once the plug is in place the pressure in the tubing string is reduced and the tool returns to its deactivated position as shown in FIGS. 1B-1 to 1B-4. Sealing cup 70 relaxes to a less substantial seal with the wellbore wall, packing element 51 which had buckled is returned to the initial position, and hydraulically actuated button slips 104 release their grip and retract into receptacle 100 as the pressure inside the tool decreases. Should the seals and hydraulically actuated buttons remain set after the pressure has been reduced, for example due to friction, the annular space between the tool and the wellbore can be pressurized from the surface to equalize the pressure across the tool and relax the slips and seals. Alternatively, the well could be killed using a kill fluid and all the pressure on the work string bled off, allowing the tool to relax.

After the tool has been returned to the relaxed position as shown in FIGS. 1B-1 to 1B-4, it can be pulled back in the wellbore any desired distance to the next section of the wellbore to be treated. The process of setting the tool and stimulating the newly isolated section of the wellbore is repeated. This process may be repeated as often as necessary until the entire horizontal or vertical section has been treated, after which the tool is retracted from the well and recovered for future use.

The invention may also be used to test isolated sections of the wellbore. To accomplish testing, the tool is connected to a work string, for example a coiled tubing or drill pipe, run into the wellbore, and positioned adjacent the interval to be tested. Protective sheath 60 of the assembly is jettisoned from the tool as described above. Following the deployment of protective sheath 60, the tool is set in the same manner as described above, except the sealing pressure is provided by the natural pressure of the formation. With the tool set in position and connected to a production tubing string, annular blowout preventors can be closed, annular pressure bled down, and the pressure from the well forces the production fluid through passageway 22 of the mandrel and into the production tubing. Production tests can then be conducted for the isolated well section.

When the production test for the first isolated well section has been completed, the tool is returned to its relaxed position as shown in FIGS. 1B-1 to 1B-4 by pressurizing the annulus or killing the well. The tool is then pulled up the wellbore and repositioned above the next interval to be tested. The tool is reset into the position shown in FIGS. 1C-1 to 1C-4 with the seals and hydraulically actuated buttons again set in place. As the production test from the newly isolated well section is conducted, a simple calculation will reveal what portion of the measured production is contributed by the segment of well extending from the previous tool position to the current tool position. The process of releasing the tool, repositioning, resetting, and testing is repeated until the desired production information from the various segments within the well is gathered.

Figure 7:
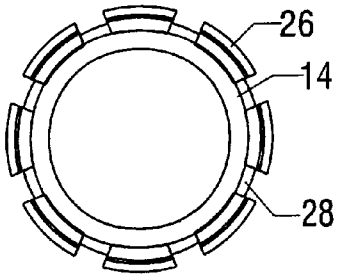
FIG. 7 depicts a top view of the control collet of the alternative embodiment.
Figure 6:
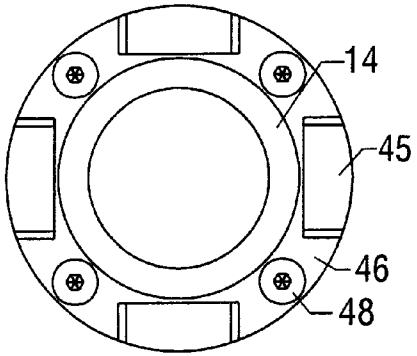
FIG. 6 depicts a top view of the cone assembly of the alternative embodiment without the anchoring slips in place.

FIGS. 4–7 illustrate an alternative embodiment of the FracShield, namely an alternative anchoring assembly and topsub. In the alternative embodiment illustrated as FIGS. 4A-1 to 4C-4, there is a control collet 24 attached to mandrel 14 just below topsub 12. The topsub position relative to mandrel 14 is secured by a plurality of set screws 20. The topsub includes external slots 18 to permit fluid bypass. Control collet 24 is disposed about the external diameter of mandrel 14. Control collet 24 includes a plurality of fingers 26 that extend beyond a shoulder 28. The shoulder is part of the outer surface of the mandrel and together with fingers 26 of control collet 24 act as a restraint to movement of a slip ring 30 relative to the mandrel. The shoulder 28 restraint is not intended to be absolute. When a force between slip ring 30 and mandrel 14 becomes sufficiently large, control collet fingers 26 are intended to disengage the shoulder and slide down relative to the mandrel. FIG. 7 shows a top view of the control collet assembly with fingers 26 engaging shoulder 28 of the mandrel.

Figures 1, 4A:
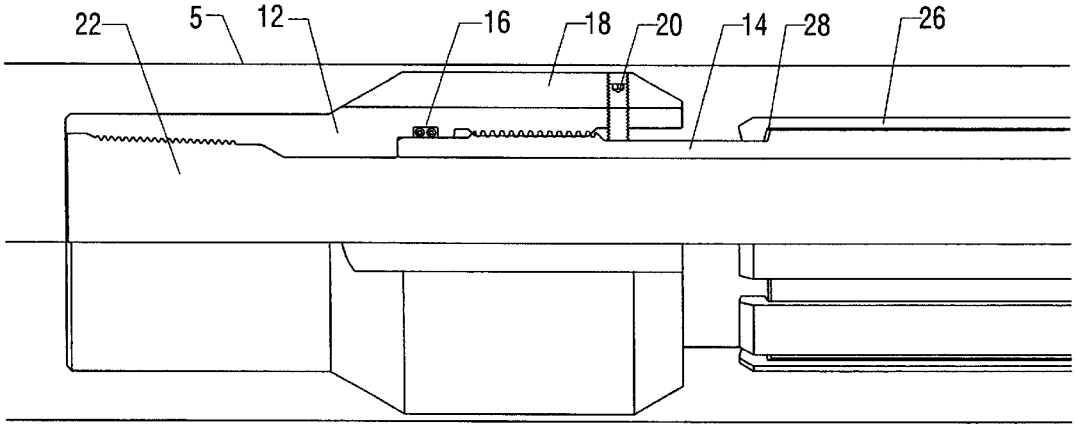
Figures 1, 4B:
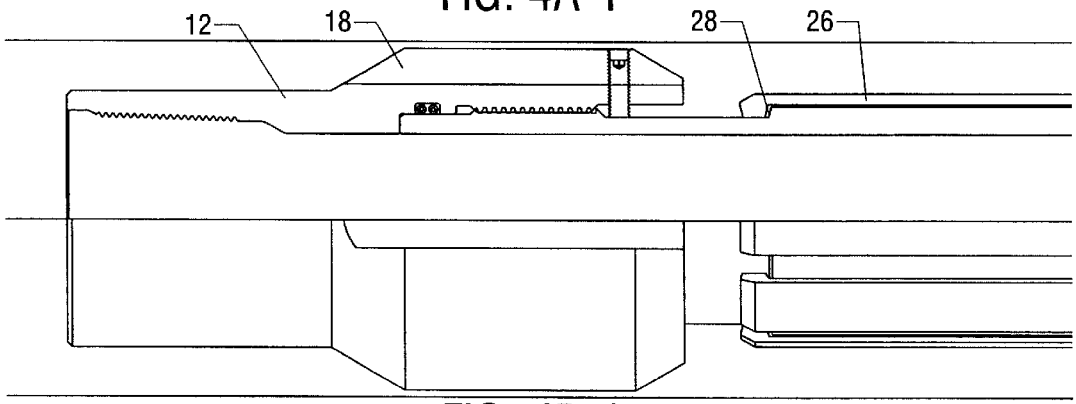
Figures 1, 4C:
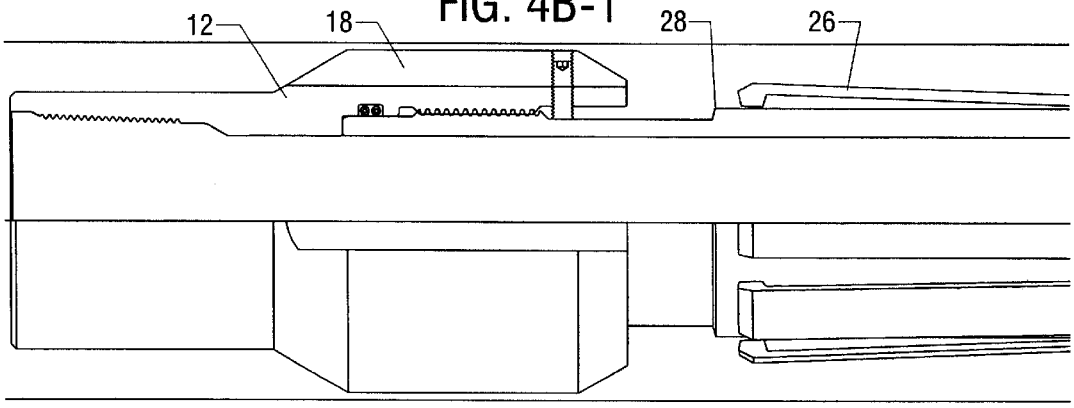
Figures 2, 4A:
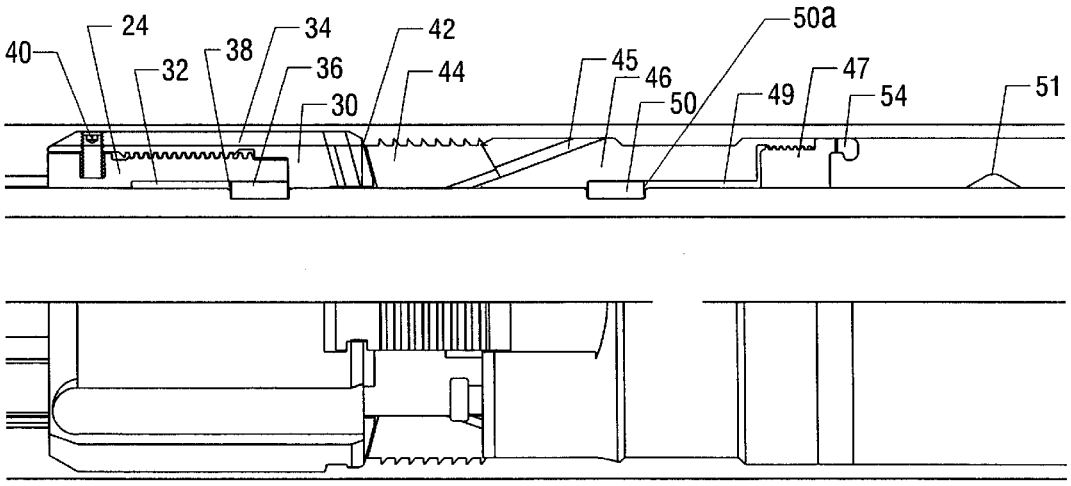
Figures 2, 4B:
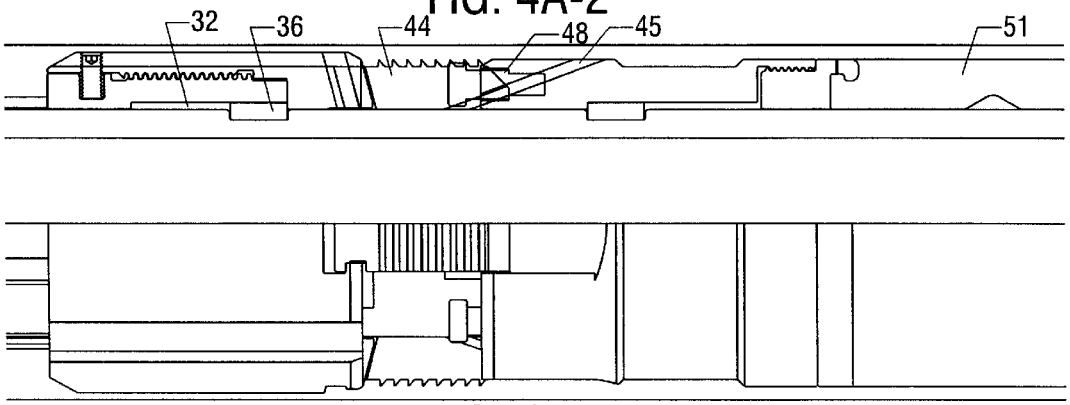
Figures 2, 4C:
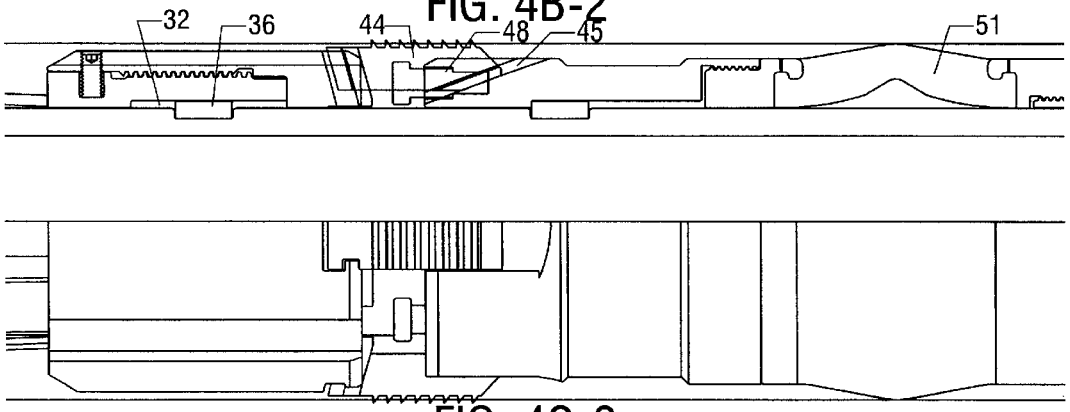
Figures 3, 4A:
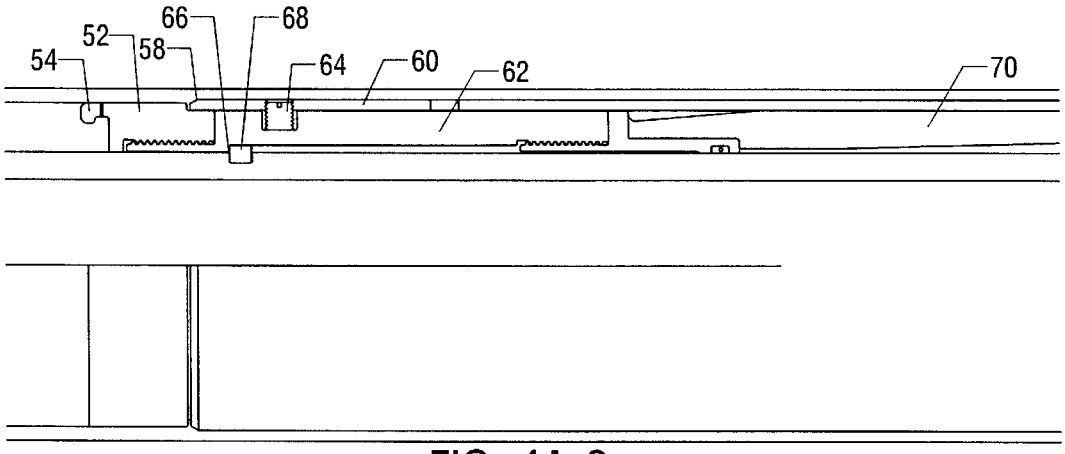
Figures 3, 4B:
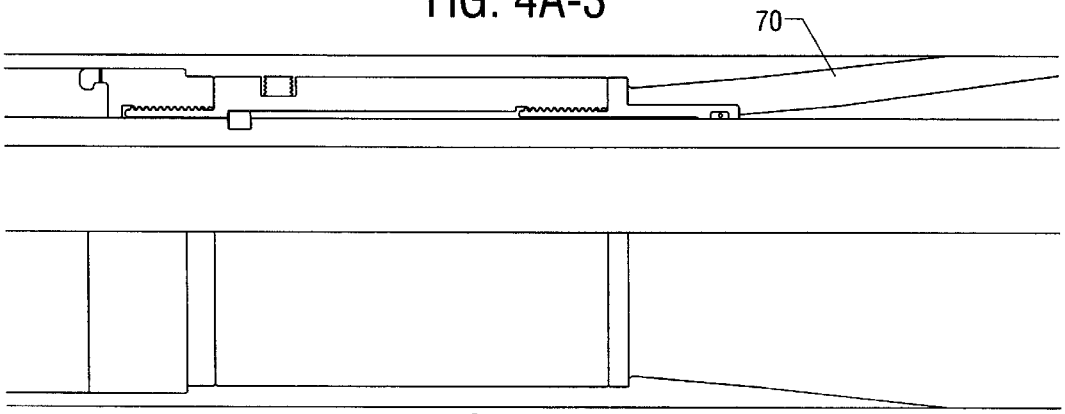
Figures 3, 4C:
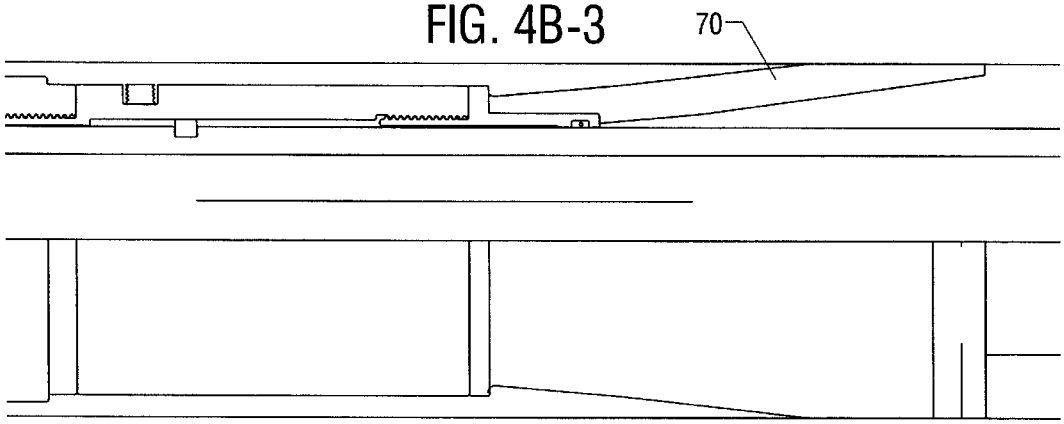
Figures 4, 4A:
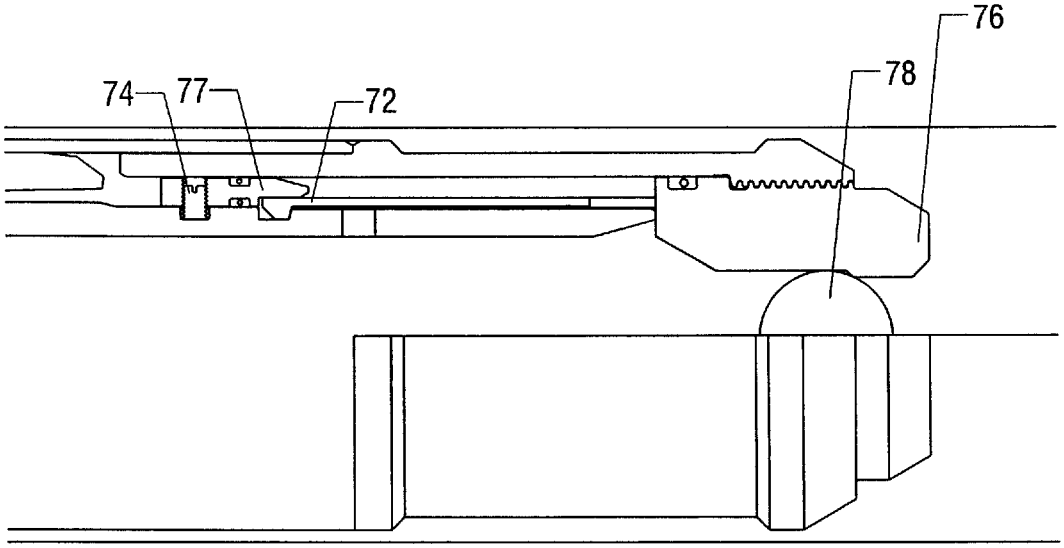
Figures 4, 4B:
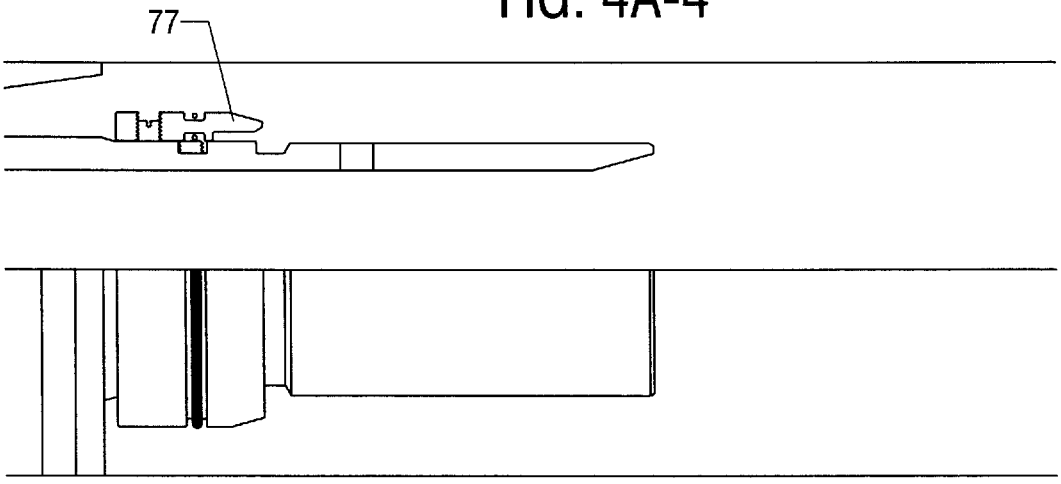
Figures 4, 4C:
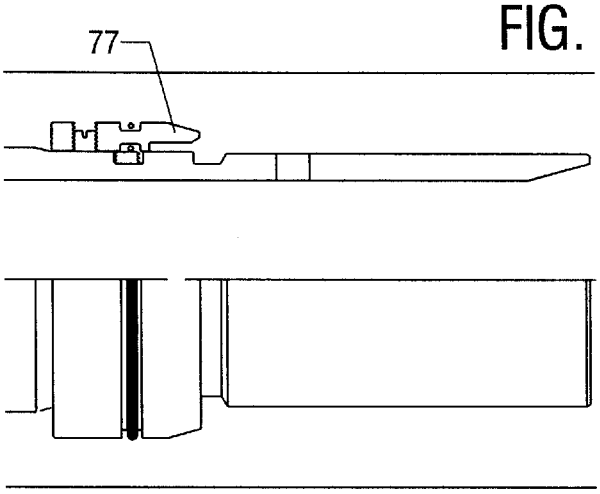

Formed on the inside diameter of control collet 24 is a counterbore 32 which creates a gap between the control collet and the mandrel that can be seen in FIGS. 4A-2 to 4C-2. A groove 38 is cut into the mandrel adjacent control collet counterbore 32, and a split ring 36 is disposed between the counterbore and groove, making contact between slip ring 30 and mandrel 14. Split ring 36 limits the movement of slip ring 30 toward the top of the tool. For example, while the tool is being inserted into a wellbore, slip ring 30 may come into contact with the wall of the wellbore and encounter some resistance to further movement. Slip ring 30 is designed for movement relative to mandrel 14, but during the insertion of the tool no relative movement is desired. Since split ring 36 is in place, further introduction of the assembly into the wellbore while slip ring 30 is encountering resistance against the wall of the wellbore will not result in movement of slip ring 30 and control collet 24 relative to mandrel 14 because slip ring 30 will make contact with split ring 36 and stop any relative movement toward the top of the tool. Control collet counterbore 32 will, however, allow for relative movement of slip ring 30 and assembly toward the bottom of the assembly when such movement is desirable. The circumstances under which the movement of slip ring 30 is desirable are discussed below.

Figure 5:
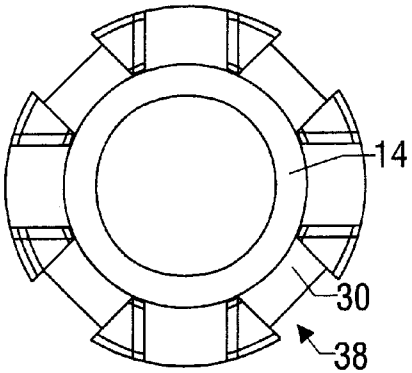
FIG. 5 depicts a bottom view of the slip ring in the alternative embodiment.

Slip ring 30, which is adjacent the control collet, includes multiple fluid bypass slots 34 to facilitate fluid bypass through the annular space between slip ring 30 and wellbore 5. These slots 34, along with slip ring 30, are illustrated in FIG. 5. Slip ring 30 is threadedly attached to the outer diameter of control collet 24 and secured in place by a plurality of set screws 40. The edge 42 of the slip ring toward the bottom of the tool is slanted, forming an obtuse angle with the outer surface of mandrel 14. Immediately toward the bottom of the tool and adjacent to slip ring 30 are a plurality of gripping slips 44 that are deposed within slots 45 of a cone 46. Cone 46 is attached about the outer surface of the mandrel by a threaded connection to upper gage ring 47. Cone 46 possesses a plurality of slots 45 cut through it, said slots being cut at such an angle that they break through the outer diameter of the cone. These slots 45 will extend slips 44 radially outward when downward longitudinal movement of the slips occurs. Slips 44 may continue to move radially outward until they either reach the walls of the wellbore and secure the tool in the desired position within the wellbore, or the stroke of cone 46 has been traversed. Disposed within cone 46 are a plurality of shoulder bolts 48 which have the purpose of limiting the movement of slip ring 30 and slips 44 to the predetermined stroke of cone 46.

On the inner diameter of cone 46 is a counterbore 49 coaxially located with a groove 50*a* cut in the outer diameter of the mandrel. A split ring 50 is disposed between cone 46 and the mandrel 14 residing within groove 50*a*. Split ring 50 has the purpose of preventing the relative movement of cone 46 toward the bottom of the mandrel.

Adjacent and attached to cone 46 is upper gage ring 47, and all components of the alternative embodiment from the upper gage ring down to the end of the tool are the same as for the preferred embodiment.

Operation of the alternative embodiment may be illustrated as follows. The FracShield is run into the wellbore on a work string and positioned adjacent to the interval of interest. The work string may consist of drill pipe, tubing, or coiled tubing. While the shield is being inserted, fingers 26 of control collet 24 are extended around shoulder 28 to prevent movement of the slip ring relative to the mandrel, which would prematurely actuate slips 44. Collet fingers 26 are necessary in the event that the slip ring comes into contact with the wall of the wellbore when the tool is retracted from the hole. For example, it may be necessary to retract the tool a certain distance in order to overcome an obstacle or to reposition the tool for further deployment. If the control collet is not engaged with the shoulder, the frictional force of the slip ring against the well might be more than the force being used to pull the tool back, and slips 44 would stroke up cone 46 and set prematurely.

Figures 1, 1A, 2, 3, 4:
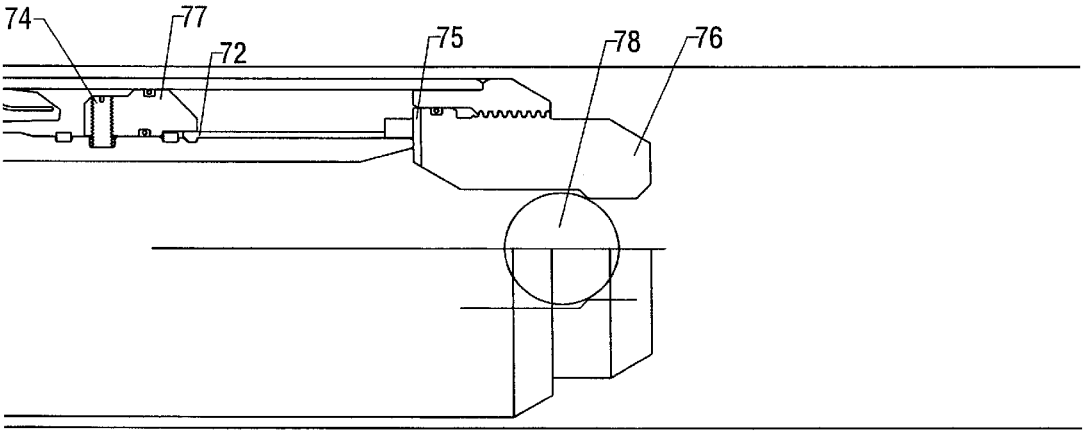
Figures 1, 1B, 2, 3, 4:
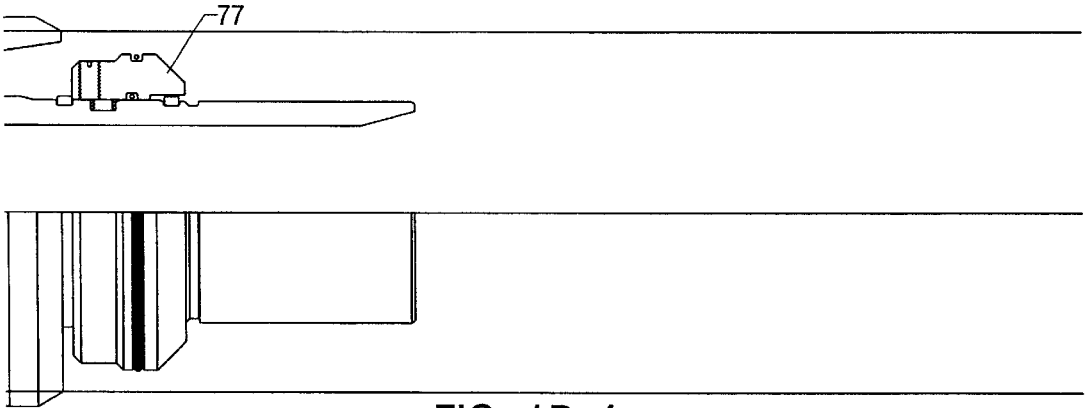
Figures 1, 1C, 2, 3, 4:
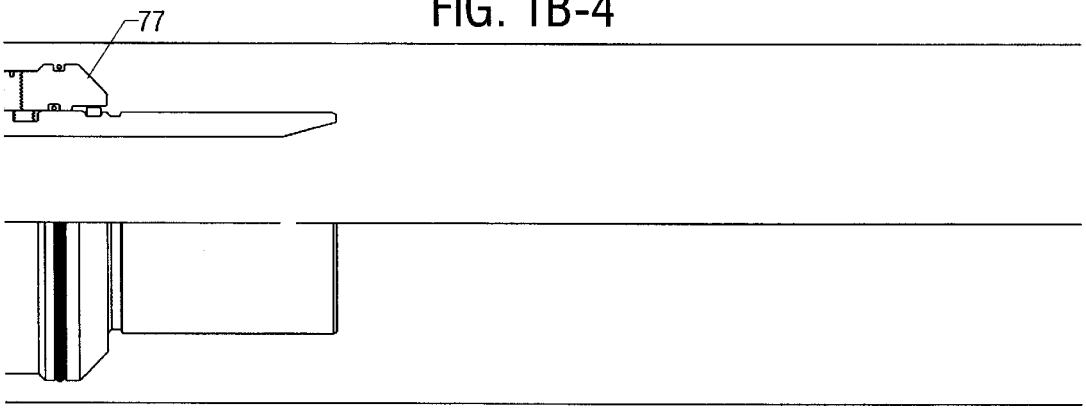
Figure 2:
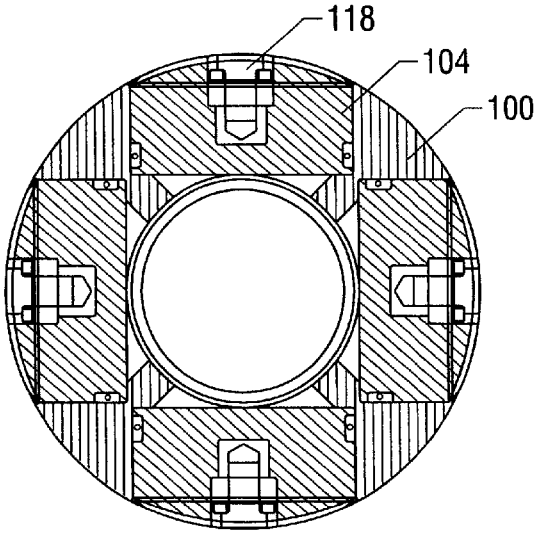
Figure 3:
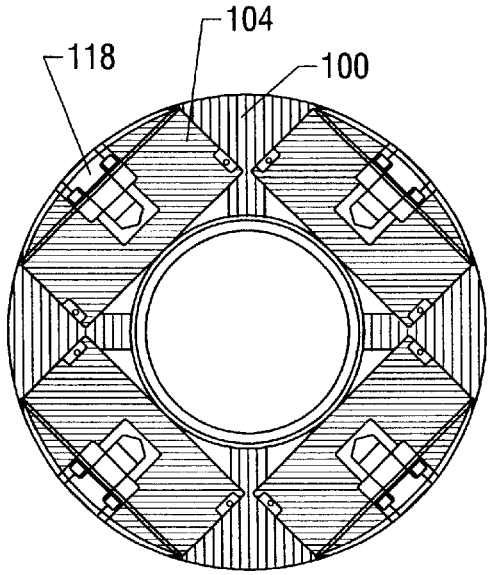

Once the tool has been positioned adjacent to the first interval of interest, the ball is deployed and circulated down through the work string in the same manner as described above for the preferred embodiment to jettison sheath 60 from the end of the tool. FIGS. 4B-1 to 4B-4 illustrates the alternative embodiment immediately after the protective sheath has been jettisoned from the tool.

Sealing cup 70 operates in the same manner in the alternative embodiment as it does in the preferred embodiment described above. However, the longitudinal force transmitted in a piston-like fashion to the packing element is further communicated in the alternative embodiment to the cone. When pressure is transmitted to cone 46, the cone moves up relative to the mandrel 14 and forces gripping slips 44 radially outward and into engagement with the casing or rock which secures the tool in place.

Once the alternative embodiment of the tool is set in place and work string pressure continues to increase, there may be some contraction of the work string as a result of cooling, high pressure, or other phenomena. The contraction of the work string will tend to pull mandrel 14 of the tool back out of the hole, as the mandrel is rigidly connected to the work string via topsub 12. To avoid movement of packing element 51, sealing cup 70, and slips 44 as the work string contracts, slip ring 30 allows movement of mandrel 14 relative to the components mounted on the outer surface of the mandrel. Control collet 24 will allow movement of the mandrel as the tubing contracts provided the contraction force exceeds the force necessary to overcome fingers 26 engaged with retaining shoulder 28. Thus, control collet fingers 26 of the alternative embodiment are designed such that they provide enough retaining force to hold slip ring 30 in position during insertion of the tool, but release prior to pulling slips 44 off of cone 46 once the tool is set in position and the work string contracts. FIGS. 4C-1 to 4C-4 show the situation herein described with slips 44 fully deployed and control collet fingers 26 no longer engaged with shoulder 28.

When the alternative embodiment has been anchored and a double seal accomplished, the isolated wellbore section can be treated and plugged in the same manner as described above for the preferred embodiment.

When the treatment is complete and the plug is in place, the pressure in the tubing string is reduced and the alternative embodiment returns to its relaxed position as shown in FIGS. 4B-1 to 4B-4. Sealing cup 70 relaxes to a less substantial seal with the wellbore wall, packing element 51 which had buckled is returned to the initial position, and slips 44 release their grip as they move back down cone 46. The tubing string is slacked off so that control collet fingers 26 return to their position engaged with shoulder 28. Similar to the preferred embodiment, should the seals and slips remain set after the pressure has been reduced (due to friction, for example), the annular space between the tool and the wellbore can be pressurized from the surface to relax the slips and seals.

After the alternative embodiment of the tool has been returned to the relaxed position as shown in FIGS. 4B-1 to 4B-4, it can be pulled back in the wellbore any desired distance to the next section of the wellbore to be treated, or it can be recovered to the surface, just as described above for the preferred embodiment.

The alternative embodiment of invention may also be used to test isolated sections of the wellbore in the same manner as described for the preferred embodiment.

While the present invention has been particularly shown and described with reference to various illustrative embodiments thereof, it will be understood by those skilled in the art that various changes in form and details may be made without departing from the spirit and scope of the invention. The above-described embodiments are illustrative and should not be considered as limiting the scope of the present invention.

What is claimed is:

1. A single trip multiple-zone isolation tool for stimulating or testing a wellbore comprising:

a mandrel having a bore therethrough;

a plurality of hydraulically actuated buttons radially arranged about the mandrel for gripping the wall of the wellbore;

a sealing cup coaxially arranged about the mandrel wherein the sealing cup is radially biased to extend toward the wall of the wellbore;

wherein the sealing cup is initially covered by a protective sheath;

wherein the hydraulically actuated buttons are operable in response to hydraulic pressure to move radially outward to engage the wellbore; and wherein the wellbore pressure downhole of the tool forces the sealing cup against the wall of the wellbore to isolate the portion of the wellbore adjacent the tool.

2. A single trip multiple-zone isolation tool for stimulating or testing a wellbore comprising:

a mandrel having a bore therethrough;

a slip assembly coaxially arranged about the mandrel having expandable slip segments for gripping the wall of the wellbore;

a sealing cup coaxially arranged about the mandrel wherein the lower end of the sealing cup is radially biased to extend to the diameter of the wall of the wellbore;

wherein the sealing cup is initially covered by a protective sheath;

wherein after the sheath is removed, the sealing cup is operable in response to hydraulic pressure to move longitudinally about the mandrel to force the slips radially outward to engage the wellbore; and wherein the hydraulic pressure increases the sealing force of the sealing cup against the wall of the wellbore to isolate the portion of the wellbore adjacent the tool.

3. The tool of claim 1 or 2 wherein the protective sheath is attached to the mandrel by at least one releasable means.

4. The tool of claim 3 wherein the releasable means comprise shear screws, collet fingers, or an interlock system.

5. The tool of claim 4 wherein the interlock system is unlocked by hydraulic pressure.

6. The tool of claim 3 wherein the releasable means comprises at least one releasable stud, wherein the stud parts in tension at a predetermined parting force.

7. The tool of claim 1 or 2 wherein said protective sheath can be jettisoned from the tool by hydraulic pressure.

8. The tool of claim 2 wherein the slip assembly for gripping the wall of the wellbore can move relative to the mandrel.

9. The tool of claim 8 wherein movement of the slip assembly for gripping the wall of the wellbore is controlled by a control collet.

10. The tool of claim 9 wherein the control collet comprises a plurality of collet fingers.

11. The tool of claim 1 or 2 wherein the mandrel is adapted for connection to a work string comprising jointed pipe or coiled tubing.

12. The tool of claim 1 or 2 wherein a secondary packing element is coaxially arranged about the mandrel above the sealing cup.

13. The tool of claim 12 wherein the secondary packing element is predisposed to buckle under the application of longitudinal force.

14. The tool of claim 13 wherein the packing element will substantially return to pre-longitudinal force condition upon removal of longitudinal force.

15. The tool of claim 1 or 2 wherein said hydraulically actuated buttons or slips relax upon substantially equalizing the internal jointed pipe or coiled tubing pressure and annular pressure, and the tool may be moved uphole and reset upon reapplying pressure to stimulate or test a different interval of the wellbore.

16. The tool of claim 1 or 2 further comprising a ball seat for receiving a sealing ball.

17. A method for stimulating a subterranean wellbore, the method comprising the steps of:

a) running an isolation tool on jointed pipe or coiled tubing into said wellbore and positioning the tool adjacent a first interval of interest, wherein the isolation tool comprises a mandrel having a bore therethrough, a plurality of hydraulically actuated buttons arranged about the mandrel for gripping the wall of the wellbore and a sealing cup coaxially arranged about the mandrel wherein the sealing cup is radially biased to extend to the wall of the wellbore, and wherein the sealing cup is initially covered by a protective sheath;

b) pressurizing the jointed pipe or coiled tubing whereby the hydraulically actuated buttons are actuated to engage the wellbore wall and the protective sheath circumscribing the sealing cup is jettisoned from the tool;

c) isolating the interval of interest with a seal formed by the sealing cup against the wellbore wall;

d) stimulating the isolated interval;

e) placing a plug between the tool and the isolated interval;

f) substantially equalizing the internal pressure of the jointed pipe or coiled tubing and tool with the annular pressure to release the tool from the wall of the wellbore;

g) moving the tool uphole a desirable distance, resetting the hydraulically actuated buttons, and forming a seal with the sealing cup by pressurizing the jointed pipe or coiled tubing;

h) stimulating the new interval;

i) substantially equalizing the internal pressure of the jointed pipe or coiled tubing and tool with the annular pressure to release the tool from the wall of the wellbore; and j) repeating steps (g)–(i) as necessary until the entire interval of interest is stimulated.

18. A method for stimulating a subterranean well, the method comprising the steps of:

a) running an isolation tool on a jointed pipe or coiled tubing into said well and positioning the tool adjacent a first interval of interest, wherein the isolation tool comprises a mandrel having a bore therethrough, a plurality of slip-on-cone-type anchoring slips arranged about the mandrel for gripping the wall of the wellbore and a sealing cup coaxially arranged about the mandrel wherein the lower end of the sealing cup is radially biased to extend to the wall of the wellbore, and wherein the sealing cup is initially covered by a protective sheath;

b) pressurizing the jointed pipe or coiled tubing whereby the protective sheath circumscribing a sealing cup is jettisoned from the end of the tool and the slip-on-cone-type anchoring slips are actuated to engage the wellbore wall;

c) isolating the interval of interest with a seal formed by the sealing cup against the wellbore wall;

d) stimulating the isolated interval;

e) placing a plug between the tool and the isolated interval;

f) substantially equalizing the internal pressure of the jointed pipe or coiled tubing and tool with the annular pressure to release the tool from the wall of the wellbore;

g) moving the tool uphole a desirable distance and reducing annular pressure to allow the sealing cup to seal and the slips to actuate again;

h) stimulating the new interval;

i) substantially equalizing the internal pressure of the jointed pipe or coiled tubing and tool with the annular pressure to release the tool from the wall of the wellbore; and j) repeating steps (g)–(i) until the entire interval of interest is stimulated.

19. A method for testing a subterranean wellbore, the method comprising the steps of:

a) running an isolation tool on a jointed pipe or coiled tubing into said wellbore and positioning the tool adjacent a first interval of interest, wherein the isolation tool comprises a mandrel having a bore therethrough, a plurality of hydraulically actuated buttons arranged about the mandrel for gripping the wall of the wellbore and a sealing cup coaxially arranged about the mandrel wherein the sealing cup is radially biased to extend to the wall of the wellbore, and wherein the sealing cup is initially covered by a protective sheath;

b) pressurizing the jointed pipe or coiled tubing whereby the protective sheath circumscribing the sealing cup is jettisoned from the tool and the hydraulically actuated buttons are actuated to engage the wellbore wall;

c) isolating the interval of interest with a seal formed by the sealing cup against the wellbore wall;

d) reducing jointed pipe or coiled tubing pressure and allowing production fluids to flow through a passageway of the tool and to the jointed pipe or coiled tubing;

e) measuring production from the isolated interval;

f) substantially equalizing the internal pressure of the jointed pipe or coiled tubing with the annular pressure to release the tool from the wall of the wellbore;

g) moving the tool uphole a desirable distance and reducing annular pressure to allow the hydraulically actuated buttons to actuate and the sealing cup to again seal;

h) measuring production from the new interval;

i) substantially equalizing the internal pressure on the jointed pipe or coiled tubing with the annular pressure to release the tool from the wall of the wellbore; and j) repeating steps (g)–(i) until the entire interval of interest is tested.

20. A method for testing a subterranean well, the method comprising the steps of:

a) running an isolation tool on a jointed pipe or coiled tubing into said well and positioning the tool adjacent a first interval of interest, wherein the isolation tool comprises a mandrel having a bore therethrough, a plurality of slip-on-cone-type anchoring slips arranged about the mandrel for gripping the wall of the wellbore and a sealing cup coaxially arranged about the mandrel wherein the lower end of the sealing cup is radially biased to extend to the wall of the wellbore, and wherein the sealing cup is initially covered by a protective sheath;

b) pressurizing the jointed pipe or coiled tubing whereby the protective sheath circumscribing the sealing cup is jettisoned from the end of the tool and the slip-on-cone-type anchoring slips are actuated to engage the wellbore wall;

c) isolating the interval of interest with a seal formed by the sealing cup against the wellbore wall;

d) reducing jointed pipe or coiled tubing pressure and allowing production fluids from the formation to flow through the interior passageway of the tool and to the jointed pipe or coiled tubing;

e) measuring production from the isolated interval;

f) substantially equalizing the internal pressure of the jointed pipe or coiled tubing with the annular pressure to release the tool from the wall of the wellbore;

g) moving the tool uphole a desirable distance and reducing annular pressure to allow the sealing cup to seal and the slips to actuate again;

h) measuring production from the new interval;

i) substantially equalizing the internal pressure of the jointed pipe or coiled tubing with the annular pressure to release the tool from the wall of the wellbore; and j) repeating steps (g)–(i) until the entire interval of interest is tested.

21. A method for stimulating a subterranean wellbore, the method comprising the steps of:

a) running an isolation tool on a jointed pipe or coiled tubing into said wellbore and positioning the tool adjacent a first interval of interest, wherein the isolation tool comprises a mandrel having a bore therethrough, a slip assembly arranged about the mandrel for gripping the wall of the wellbore and a sealing cup coaxially arranged about the mandrel wherein one end of the sealing cup is radially biased to extend to the wall of the wellbore and wherein the sealing cup is initially covered by a protective sheath;

b) releasing the protective sheath from the tool to expose the sealing cup;

c) actuating the slip assembly to engage the wall of the wellbore;

d) isolating the interval by forming a seal against the wellbore wall with the sealing cup;

e) stimulating the interval;

f) releasing the tool from the wall of the wellbore;

g) moving the tool uphole and positioning the tool adjacent a new interval and repeating steps (c)–(g) until all intervals of interest have been stimulated.

22. A method for testing a subterranean wellbore, the method comprising the steps of:

a) running an isolation tool on a jointed pipe or coiled tubing into said wellbore and positioning the tool adjacent a first interval of interest, wherein the isolation tool comprises a mandrel having a bore therethrough, a slip assembly arranged about the mandrel for gripping the wall of the wellbore and a sealing cup coaxially arranged about the mandrel wherein one end of the sealing cup is radially biased to extend to the wall of the wellbore and wherein the sealing cup is initially covered by a protective sheath;

b) releasing the protective sheath from the tool to expose the sealing cup;

c) actuating the slip assembly to engage the wall of the wellbore;

d) isolating the interval by forming a seal against the wellbore wall with the sealing cup;

e) testing the interval;

f) releasing the tool from the wall of the wellbore;

g) moving the tool uphole and positioning the tool adjacent a new interval and repeating steps (c)–(g) until all intervals of interest have been tested.

23. The method of claim 17, 18, 19, 20, 21, or 22 wherein the step of isolating the interval of interest further comprises actuating a secondary packing element to form a secondary seal against the wellbore wall.

24. The method of claim 17, 18, 19, or 20 wherein the step of pressurizing the work string further comprises circulating a ball or dart down the work string to seal against a seat.

25. The method of claim 17, 18, or 21, wherein the step of stimulating the interval further comprises hydraulic fracturing.

26. The method of claim 17, 18, or 21, wherein the step of stimulating the interval further comprises acidizing the interval.

27. The method of claim 21, wherein a plug is placed following each interval treatment.

28. The method of claim 17, 18, or 27, wherein said plug comprises a sand plug.

29. The method of claim 17, 18, or 27, wherein said plug comprises a chemical plug.

30. The method of claim 17, 18, or 27, wherein said plug comprises a mechanical plug.

31. The method of claim 21 or 22, wherein the step of releasing the tool from the wall of the wellbore further comprises pressurizing the annulus.

* * * * *